US006164305A

United States Patent [19]

Herman

[11] Patent Number: 6,164,305

[45] Date of Patent: Dec. 26, 2000

[54] MOBILITY ASSISTING DEVICE

[76] Inventor: Harry H. Herman, 3003 VanNess St. NW. Suite 616, Washington, D.C. 20008

[21] Appl. No.: 09/236,518

[22] Filed: Jan. 25, 1999

Related U.S. Application Data

[60] Continuation-in-part of application No. 08/841,789, May 5, 1997, Pat. No. 5,862,824, which is a division of application No. 08/266,778, Jun. 29, 1994, Pat. No. 5,640,986.

[51] Int. Cl.[7] ..... A61H 3/02

[52] U.S. Cl. ..... 135/68; 135/69; 135/82

[58] Field of Search ..... 135/68, 69, 82, 135/67, 65, 71, 73; 248/188.3

[56] References Cited

U.S. PATENT DOCUMENTS 5,113,887 5/1992 Harry ..... 135/68

5,217,033 6/1993 Herman ..... 135/68

*Primary Examiner*—Beth A. Stephan

*Attorney, Agent, or Firm*—Roylance, Abrams, Berdo & Goodman, L.L.P.

[57] ABSTRACT

A mobility assisting device which includes a vertical support structure pivotally coupled to a substantially planar base structure. The vertical support structure can have an underarm support so that the base remains parallel to the ground as the base moves relative to the ground. The underarm support is mounted to the vertical support structure so as to be pivotal relative thereto to avoid the translation of pressure points under the patient's arms and rubbing between the upper end of the support and the underarm. The underarm support is angled relative to the plane of the device increase the comfort to the user. The base is biased perpendicular to the support structure by a resilient shock dampening pad between the support structure and the base.

19 Claims, 5 Drawing Sheets

FIG. 4
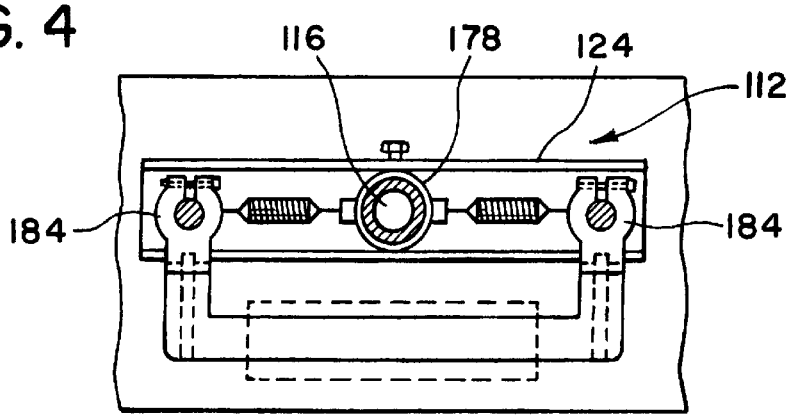
FIG. 5
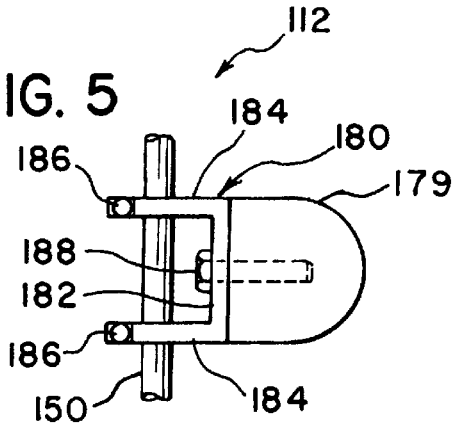
FIG. 6
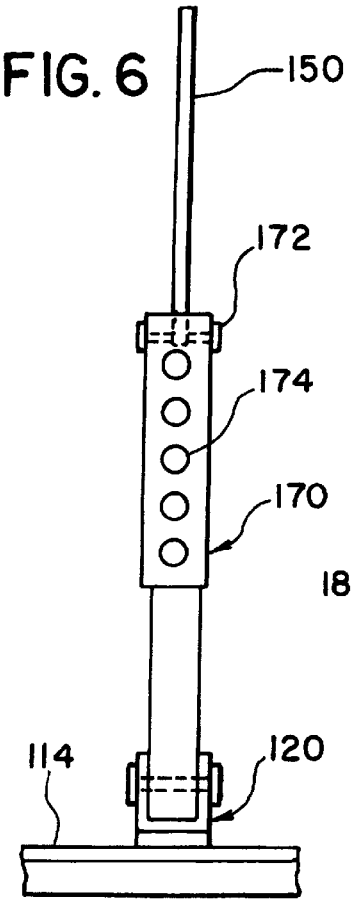
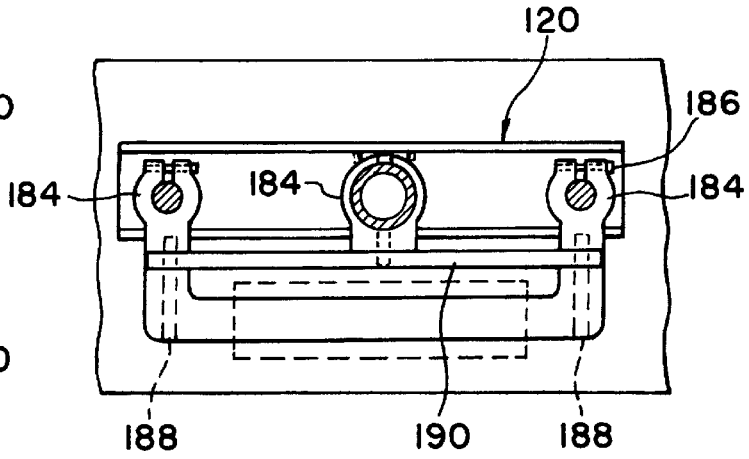
FIG. 7

MOBILITY ASSISTING DEVICE

CROSS-REFERENCE TO RELATED APPLICATION

This application is a continuation-in-part application of U.S. application Ser. No. 08/841,789 filed May 5, 1997, now U.S. Pat. No. 5,862,824 which is a divisional application of Ser. No. 08/266,778 filed Jun. 29, 1994, now U.S. Pat. No. 5,640,986.

FIELD OF THE INVENTION

The present invention relates to devices for assisting handicapped individuals while walking. More particularly, the invention relates to an improved crutch-type and cane-type device.

BACKGROUND OF THE INVENTION

Mobility is essential to functioning independently, particularly in today's highly mobile society. Thus, mobility is of constant concern to those individuals who are incapable of walking or who are limited in their ability to walk normally.

Crutches and canes require the user to balance himself on the bottom tip of the support which contacts the walking surface. However, the rubber-coated tip of the crutch has a cross-sectional area of at most about 3 square inches which can slip on rocks, loose gravel, ice and wet or uneven surfaces. This is also true for canes, walkers and walking sticks.

Conventional crutches are uncomfortable and can be hazardous to the user. Crutches do not ergonomically fit people in a satisfactory manner. To prevent interference with the arms and body, conventional crutches must be used at an angle of 10° off the vertical with the base tip away from the user's feet. Thus, conventional crutches cannot be correctly used in the vertical plane parallel to the user's body and they must be used so that the longitudinal axis thereof is not at a right angle to the walking surface. The angle at which the tip of the crutch contacts the ground not only from forward to rear, but also laterally, does not lend itself to proper traction. This lateral angle causes the fixed upper end of the crutch to place force against the upper ribs under the arms and the nerves in the axilla and in particular the radial nerve which can cause discomfort and injury. The forward and rear motion of the crutch and the resulting underarm motion causes abrasion by the upper end movement of a pressure point from a forward point to a rearward point under the arm as the crutches pivot relative to the ground from their forward to their rearward position. Thus, the practice is to place padding on the upper end of the crutch to prevent injury to the user.

Proper use of crutches require that no weight be placed on the underarm. The hands and arms are supposed to carry all the weight. Experience has shown that most users do not have sufficient arm and hand strength to accomplish this and often improperly use the crutches resulting in accidents and injuries.

Crutch mobility under normal use is dependent upon one leg of the user leaving the ground and swinging forward like a pendulum to the forward point where it contacts the walking surface. The foot in contact with the walking surface then acts as a fulcrum while the crutches move off the surface from the rear position to the forward position. Crutches therefore operate on the basis that the top of the crutch moves in the form of an arc with the apex in the vertical or upright position. This means that the user of a crutch must be raised then lowered by the use of the underarm rest. The effort required to move forward on a crutch is increased due to the need to have a force or momentum in the action sufficient to lift the user during each forward step of the crutch. This lifting force also places cyclic forces upward on the user's underarm and shoulders. When the user drops in the forward position, their feet or foot impacts the ground and can cause injury and discomfort especially to those with additional functional limitations or the elderly or frail.

It is therefore desirable to provide devices including a crutch for assisting the mobility of injured or handicapped individuals which provide a stable base structure that is ergonomically correct, does not require much instruction to use and minimizes the likelihood of slippage on wet or icy surfaces or that an uneven or rough walking surface will inhibit the stability of the crutch structure and thereby the mobility of the individual.

It is desirable to provide a crutch-like structure that minimizes the discomfort and possible injury to the individual's hand, feet, arm or underarm during use.

SUMMARY OF THE INVENTION

The present invention has the primary object of providing devices for assisting the mobility of injured or otherwise handicapped individuals by providing a stable base structure which remains substantially parallel to and flat on the ground surface throughout motion of the individual relative to the ground.

A further objective of this invention is to provide an apparatus for maintaining the hand hold, handle, or underarm grip parallel to the ground, so that there is no abrasive or rubbing action to the hands or underarm.

To achieve the foregoing objects, the mobility assisting device of the present invention provides a base which is articulated relative to a vertical support structure thereof so that the base remains in parallel relation to the ground as the user rests upon and/or holds the device and moves relative to the ground. Further, the invention provides a weight bearing surface which does not move relative to the portion of the user's anatomy which it contacts.

Additional features of the invention include the articulation of the base with respect to the vertical support structure of the crutch and cane system while being biased in an upright position. The vertical support structure is able to pivot in a side-to-side direction as well as in a forward and backward direction to enable the base to make full contact with an inclined or uneven walking surface. The articulated connection between the support structure and the base also provides some shock dampening to increase the comfort to the user.

A further object of the invention is to provide a shock absorbing device in the vertical support structure to reduce the shock of the base striking the ground from being transferred to the user. The shock absorbing device may be in the base, vertical structure or underarm support.

To facilitate a more ergonomically designed kinematic crutch assembly, the underarm support is placed at an angle with respect to a longitudinal base of the base or the plane of the vertical support structure. Typically, the underarm support will be about 10°–20° to the longitudinal dimension of the base or the plane of the vertical support structure. In embodiments of the invention, the angle of the underarm support with respect to the base is adjustable to accommodate the needs of the particular user.

These and other objects of the invention are basically attained by a mobility assisting device comprising a substantially planar base support; a vertical support structure pivotally coupled to the base support structure; an underarm support pivotally coupled to the vertical support structure whereby, in use, the base support structure and the underarm support pivot relative to the vertical support structure so as to remain substantially parallel to the ground surface. The vertical support structure comprises a vertical support rod having a first end pivotally coupled to the base support and a second end pivotally coupled to the underarm support. A first and second tension member extends from the ends of the base to the ends of the underarm support to cause the base and underarm to remain substantially parallel to each other. A hand grip element extending between the first and second vertical tension members and are pivotally coupled thereto.

Other objects, features and characteristics of the present invention will become more apparent upon consideration of the following description and the appended claims with reference to the accompanying drawings which form a part of this specification, wherein like reference numerals designate corresponding parts in the various figures.

BRIEF DESCRIPTION OF THE DRAWINGS

The following is a brief description of the drawings in which:

FIG. 4 is a cross-sectional view of the device taken along line 4—4 of FIG. 1;

FIG. 5 is a partial side elevational view of the handle assembly coupled to the tension rod of embodiment of FIG. 1;

FIG. 6 is a partial end view of a height adjustment device which couples the tension rod assembly to the base assembly in a further embodiment of the invention;

FIG. 7 is a partial cross-sectional view of an alternative embodiment of the handle assembly pivotally coupled to the vertical support;

DETAILED DESCRIPTION OF THE INVENTION

Figure 1:
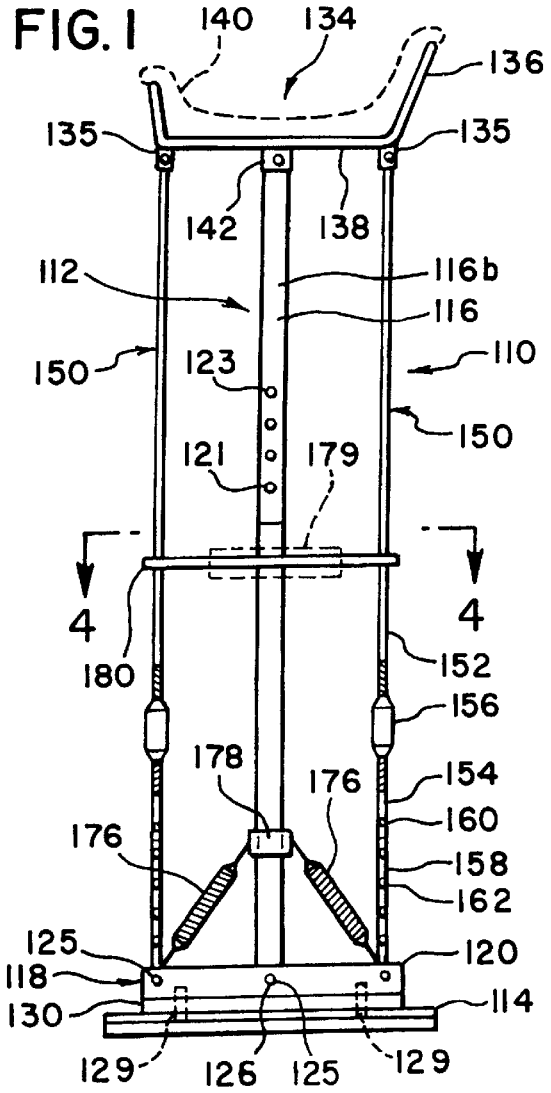
FIG. 1 is a side elevational view of a first embodiment of the device in accordance with the present invention.

A first embodiment of the invention is shown in FIG. 1. The crutch-like device 110 having a parallelogram configuration includes a substantially vertical main support structure 112 with a lower end pivotally coupled to a substantially horizontal base support structure 114 and an upper end coupled to an underarm support. The rod member may be solid or hollow formed from, for example, polyvinyl chloride (PVC), wood, aluminum, fiberglass, and graphite piping.

In embodiments of the invention, the underarm support is shaped to fit the user's underarm and contains padding sufficient to obtain full or near full contact with the maximum amount of underarm surface. This is essential not only for comfort, but also so that the weight is more evenly distributed over the underarm thereby reducing the applied force per unit area.

In embodiments of the invention the crutch assembly is collapsible. When travelling or riding in a vehicle, or for storage, it is desirable to be able to reduce the size of the assembly. This may be by means of telescoping the vertical support structure thereby reducing the overall length or by having a joint or hinge which will lock when open, but may be unlocked and pivoted so as to fold the vertical system reducing its length and space requirements.

Individuals using mobility assistance devices often require means to carry such items as briefcases, purses, food, beverage containers, water bottles, medication or monitoring apparatus. The crutch can include cup holders, water bottle holders, brackets or hangers and specially designed saddle bags. The attaching means also can be used for carrying a cellular telephone and other communication equipment, radio and tape players, proximity warning systems, security and safety alarms, and speakers and microphones therefor.

In embodiments of the invention, the underarm support can be offset relative to the vertical plane of the vertical support structure 112 so that in use, the vertical support structure 112 is offset from the user's body. This offset dimension can be adjusted to fit the size of the user.

Figure 2:
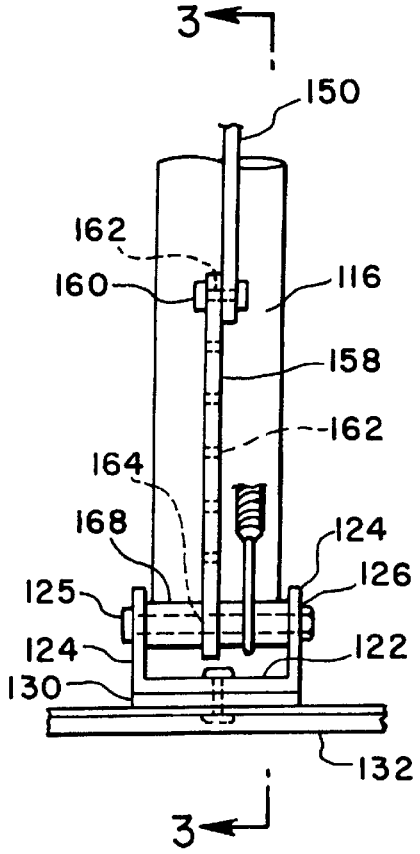
FIG. 2 is a partial end view of the base assembly of the embodiment of FIG. 1.
Figure 3:
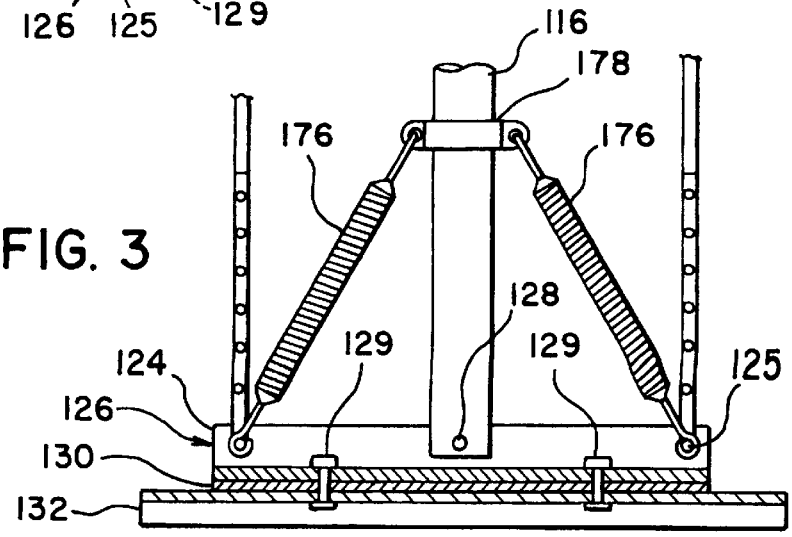
FIG. 3 is a partial side view of the base assembly in partial cross-section of the embodiment of FIG. 1 and taken along line 3—3 of FIG. 2.

Referring to FIG. 1, the crutch assembly 110 includes a vertical support rod 116 pivotally coupled to a base 114 by a pivotal joint 118. The pivotal joint 118 allows articulation of the base 114 with respect to the vertical support rod 116 in a side-to-side direction and in a forward and backward direction to enable the base 114 to fully engage the ground regardless of the incline of the ground with respect to the assembly. As shown in FIGS. 1–3, the pivotal joint 118 includes a bracket 120 having a substantially U-shape with planar bottom wall 122 and parallel upright side walls 124 defining an elongated channel. The vertical support rod 116 is coupled to the U-shaped bracket 120 by a bolt 125 extending through aligned holes 126 in each of the upright side walls 124 and hole 128 in the vertical support rod 116. The bolt 125 extending through the bracket 120 and vertical rods 116 allow the vertical rod to pivot in the plane of the longitudinal dimension, of the bracket 120.

The bracket 120 is coupled to the base 114 by bolts 129 extending through a hole in the bottom wall 122 and through a hole in the base 114. In further embodiments, pins or rivets can be used to couple the bracket 120 to the base 114. The hole in the bottom wall 122 and the length of the bolts 129 are dimensioned to allow some pivotal movement of the bracket 120 with respect to the base. A resilient shock dampening pad 130 is positioned between the U-shaped bracket 120 and the base 114. The shock dampening pad 130 has a length and a width substantially equal to the dimension of the bracket 120. A resilient, non-skid pad 132 covers the bottom surface of the base 114.

The bolts 129 coupling the U-shaped bracket 120 to the base 114 are tensioned against the resilient pad 130 so that the bracket 120 and the base 114 positively engage the resilient pad 130 and bias the bracket and vertical support tubes 116 in an upright position with respect to the base 114. The resilience and compression resistance of pad 130 in combination with the two bolts 129 passing through the U-shaped bracket 120 allow the bracket 120 to pivot slightly in a side-to-side direction on the base 114 while being biased in the normal upright position as shown in FIG. 3. The base 114 engages the ground regardless of the angle of the support structure with respect to the ground by the base pivoting in a first longitudinal direction with respect to the plane of the support structure and in a second transverse direction perpendicular to the first direction. Further, the base 114 is biased to the normal upright position by separate biasing means in each direction. The resilient pad 130 is preferably a polymeric rubber-like material such as, for example, neoprene foam. In embodiments, the resilient pad and the non-skid pad are of the same material and have the same thickness. Typically the pad has a thickness of about ⅜ to ½ inch thick.

The bolts coupling the various elements together may be a standard nut and bolt assembly to allow easy disassembly and repair. Alternatively, a pin and retainer clip may be used. In embodiments of the invention, the base 114 may be detachable to allow replacement of the base with a different size or shape of base.

The vertical support structure 116 is preferably adjustable and collapsible by including telescoping tubes with suitable locking mechanism to adjust the height to the user. In the embodiment shown in FIG. 2, the locking mechanism is a spring biased detent which engages a hole in the telescoping tube. In preferred embodiments standard spring loaded push buttons can be used. A spring biased detent 123 is provided in rod 116 to selectively engage one of the holes 121. An upper hollow tube 116*b* also includes a plurality of holes 121 for receiving a spring biased detent 123. The height is adjusted by pressing the detent inwardly and sliding the outer tube over the detent until the detent snaps into the adjacent hole.

In embodiments illustrated, a tension member 150 extends from each end of the underarm support to the bracket. Preferably the tension member is a tension rod having an upper rod 152 and a lower rod 154 coupled together by a turn buckle 156 to apply tension to the tension rods. In further embodiments, other devices can be used to selectively adjust the tension of the rods. Alternatively, the tension member 150 can be a cable attached to the base and extends to a spindle on the underarm support to a common spool or spindle which can be wound to tighten the cable and apply the necessary tension. A suitable ratchet assembly, crank or windless can be used to tighten the cable and lock the cable in the desired position. The tension members 150 act as a lever arm as discussed hereinafter and generally are not intended to support the weight of the user. The weight of the user is generally absorbed by the vertical support rod 116.

The tension rods 150 have a generally flat portion at the upper end with an aperture for receiving a pin or other fastener. The underarm support 134 includes a bracket 135 for attaching to the pin for coupling the tension rod 150 to the underarm support 134. In the embodiment illustrated, the bracket 135 is a substantially U-shaped member having an aperture in each leg for receiving the pin and coupling the tension rod to underarm support. Other hooks and clamp arrangements can be used to attach the tension rod to the underarm. In further embodiments of the invention the bracket has a length about the diameter of the vertical support tube and the resilient pad is dimensioned accordingly. The springs can be attached to the base by a suitable hook or other fastener.

The lower rod portion 154 of the tension rod 150 in the embodiment is coupled to a bar 158 by a bolt 160 or pin. As shown, the bolt 160 extends though one of a plurality of apertures 162 in the bar 158 to selectively adjust the length of the tension members 150 and the distance between the underarm support 134 to the base 114.

The bar 158 has a bottom end having a single aperture 164 for receiving the bolt 125 and coupling the bar 158 to the bracket 120. In a preferred embodiment of the invention, the bolt extends though a spacer 168, such as a cylindrical sleeve, to position the bar in substantially the center of the bracket 120. In further embodiments, the spacer 168 can position the bar at any desired location with respect to the base 120. Similar spacers are also proved to position the spring 176 at a desired location on the bolt. Preferably the spacers position the spring from the bar and from the side member of the bracket to prevent the spring from rubbing against the bar and the side wall of bracket 120.

In an alternative embodiment shown in FIG. 6, the length of each tension rod 150 is adjusted by a telescoping tube assembly 170. As show, the tension rods are coupled to an upper tube member by a suitable pivot pin 172. A lower tube slides within the upper tube to adjust the length of the tension rod. In the embodiment shown, the upper tube includes a plurality of holes 174 for receiving locking pins to adjust the length of the assembly.

Referring to FIGS. 1 and 2, a pair of springs 176 extends from the ends of the bracket 120 to the vertical support rod 116. A bracket 178 on the vertical support rod 116 is spaced from the lower end a distance to provide sufficient tension to the springs 176 to bias the vertical support rod in an upright position with respect to the base. The vertical support rod 116 can be coupled to the center of the base and the springs 176 are coupled to opposite ends of the base. Generally each of the springs are of the same length and of the same tension to bias the vertical rod in a position substantially perpendicular to the base. In alternative embodiments, the springs 176 can be different lengths or have different tensions to bias the vertical support rod at an angle with respect to the base.

Referring to FIGS. 4 and 5, the hand grip 179 or handle is pivotally attached to the tension rods 150 by a pivot member 180 at each end. The pivot member 180 in the embodiment illustrated has a substantially U-shape having a base 182 and a pair of arms 184 for attaching to the tension rods 150. The arms 184 have the shape of a split ring for surrounding the tension rod and include a threaded screw 186 to tighten the split ring around the tension rod. The base 182 has an aperture for receiving a pivot pin 188 extending though the handle. The pivot pin 188 can be a threaded screw or rivet. Each of the pivot members 180 is fixed to the tension rods so that the handle pivots in response to the movement of the tension rods. In alternative embodiments, other forms of pivot members can be used.

In an alternative embodiment shown in FIG. 5, a horizontal crossbar 190 is pivotally attached to the pivot members attached to each of the tension rods and to the vertical support rod 116. The hand grip 112 is coupled to the crossbar 190. In this embodiment, the hand grip 112 and cross bar 190 is attached to the vertical support rod and the tension rods. The crossbar 190 couples the tension rods and the vertical support rods together to stabilize the assembly.

In the embodiment of FIG. 1, the underarm support 134 is a rigid structure generally conforming to the shape of the user's underarm. The underarm support 134 is a rigid member with a substantially U-shape having a pair of upright legs 136 extending from each end of a horizontal bar 138. As shown in FIG. 1, the legs 136 extend at an acute angle from the bar 136, typically at about 30°. The horizontal bar 136 is pivotally connected to the upper end of the vertical support rod 116 by the bracket. A resilient foam cushion material 140 encases the underarm support to provide added comfort to the user by making maximum contact with the underarm. The cushion material 140 provides maximum contact with the underarm to enable the user to place their weight on the underarm support without irritation. Typically, the cushion material 140 provides about 18 square inches of contact with the underarm. The underarm support is preferably readily removable so that different size underarm supports can be attached to the vertical support rods depending on the size of the user. A removable coupling can be used to allow rapid replacement of the underarm support without changing the spacing between the vertical support rods since the spacing of the rods is independent of the size of the underarm support.

In preferred embodiments, the underarm support is dimension to fit snugly under the user's arm to provide full support thereby permitting the user to place a substantial portion of their weight on the underarm support 134. Since the dimensions of the arm and shoulder vary with the user, it is preferable to provide different size underarm supports to accommodate different users. The upright legs 136 are preferably angled with respect to the bar 138 to firmly engage the front and rear surfaces of the shoulder of the user to provide substantially uniform distribution the weight of the user throughout the underarm. In addition to the replaceable underarm support, the upper tubes 116 may also be replaceable to accommodate different size patients. In this manner, the same basic assembly may be used for different size people.

To facilitate a more ergonomic design of the crutch, the underarm support 134 can be placed at an angle relative to the plane of movement of the vertical support rod 116 and the base 114. The underarm can be placed at an angle with respect to the plane of the vertical support and the tension rods. Typically, it is desirable to have the base 114 move and point in the direction of travel. Since the angle of the underarms is generally about 10–20 degrees with respect to the forward direction of travel of a person, the base becomes toed inward when the underarm support is parallel to the support structure. Placing the underarm support at an angle which is the same as the angle of the underarm eliminates this problem, and enables full underarm contact while enabling the base to point directly forward during use of the crutch. The entire crutch system functions without causing any strains on the body, making it safer, easier to use and to operate.

In use, the vertical support tube 116 will assume a normal upright position as shown in FIG. 1. When the base 114 is positioned in a forward position with respect to the user and the vertical support rod 116 is not perpendicular to the ground, the base 114 is able to pivot and remain substantially parallel to the ground and make full contact with the ground. The resilient pad 130 further functions as a shock absorber to reduce the shock of the base striking the ground from being transferred through the vertical support rod 116 to the user.

In an alternative embodiment, the vertical support rod 116 and U-shaped bracket 120 are coupled to the base 114 by a coil spring (not shown) instead of the resilient pad. In this manner, the vertical support tube 116 is able to pivot in two directions with respect to the base when the base is on an inclined surface. The base is spring biased back to its normal position perpendicular to the vertical support tube when the base 114 is lifted from the ground. The biasing of the base 114 with respect to the U-shaped bracket 120 further provides a shock dampening affect when the base engages the ground. In further embodiments, a shock dampening arrangement can be provided in the support structure or in the underarm support.

The embodiment of FIG. 1 shows a standard cushioned handgrip. In alternative embodiments handgrips or other means may be used to accommodate the particular needs of the person. For example, a cuff may be used to accommodate a prosthetic arm. A handhold with finger holes to enable an arthritic patient to grip the crutch may also be used.

The crutch 110 of FIG. 1 is used and functions in a manner where the vertical support rod 116, base 114 and underarm support 134 form a parallelogram. In this manner, the base 114 is able to remain essentially parallel to the ground at all times and the underarm support will not slide or rub against the user's underarm. The underarm support remains in a fixed position with respect to the user's underarm since the support rod 116 is able to pivot with respect to the underarm support. The tension rods are coupled to the underarm support 134, the base, and the handle so that the tension rods pivot with respect to the underarm support and remain substantially parallel to the vertical support rod 116. The handle and the base remain substantially parallel to the underarm support 134 during movement of the crutch assembly. An advantage of the mobility assisting device of the invention is the ability of the device to stand in an upright position without falling over.

Figure 8:
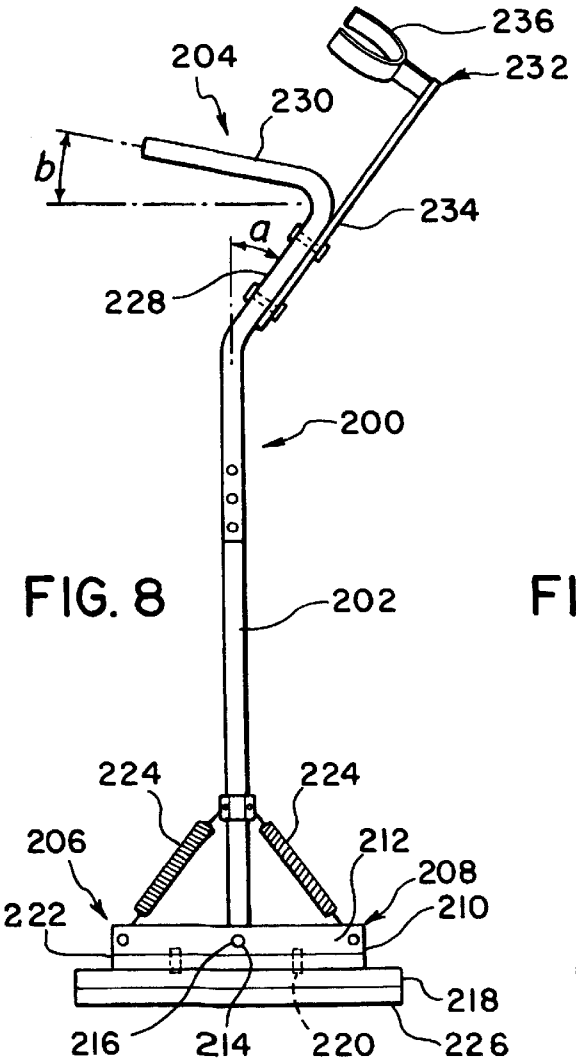
FIG. 8 is a side elevational view of cane device in a further embodiment of the invention showing the pair of springs extending from the vertical member to the base structure.

A further embodiment of the invention shown in FIGS. 8–15 uses a base structure similar to the embodiment of FIG. 1 as a cane 200. The cane 200 includes a vertical rod 202 having a handle 204 at the upper end thereof. In the embodiment illustrated the length of the vertical support rod 202 is adjustable by telescoping tubes and snap buttons. Alternatively, the handle may be a forearm crutch. The lower end of the rod 202 is pivotally coupled to the base assembly 206. The base assembly 206 includes a channel shaped bracket 208 having a bottom wall 210 and a pair of upright side walls 212. A bolt or pin 214 extends through aligned holes 216 in the each side wall 212 and the rod 202 to pivotally connect the rod 202 to the bracket 208 as shown in FIG. 8. The bracket 208 is coupled to a base plate 218 by a pair of bolts 220. A pad of a resilient cushion material 222 is positioned between the bracket 208 and base 218 to allow articulation of the bracket 208 with respect to the base 218 in a manner similar to the embodiment of FIG. 1. A pair of springs 224 extends from each end of the bracket 208 to the rod 202 to spring bias the rod 202 to a perpendicular position with respect to the base 218. In further embodiments the bracket has a length less than the length of the base and the lower ends of the springs are attached to the base by a hook or other fastener. A non-skid pad 226 similar to a rubber shoe sole is attached to the lower surface of the base 218. In further embodiments, a removable device having a plurality of gripping teeth can be attached to the pad 226 for gripping on snow and ice.

As shown in FIG. 8, the handle a first angled section 228 and a second angled section 230 for gripping by the user. The first angled section 228 in the embodiment shown extends at an angle (a) of about 20 degrees from the longitudinal axis of the vertical support rod 20 and has a length of about 7 inches. The second angled section 230 extends at an angle (b) of about 92.5 degrees from the longitudinal axis of the vertical support rod 202. Preferably the second angled section is at an angle of about 2.5 degrees from the horizontal when the vertical support rod 202 is perpendicular to the base. Generally, the second angled section has a length of about 4 to 7 inches to provide a suitable handle portion for the user to easily grip the handle. The length of the second angled section is sufficient to enable the user to grip the handle over the center of the vertical support rod 116 so that the weight is applied directly over the vertical rod. Preferably, the second angled section has a length so the center of gravity of the handle is positioned over the vertical support rod 202 whereby the cane is able to stand in an upright position by itself. Alternatively, the tension of the springs can be adjusted to compensate for the center of gravity. The angle of the second angled section is preferably at an incline with respect to the ground when the vertical support rod is vertical.

In use, the cane 200 is used in a conventional manner. The handle portion of the cane can be gripped in either direction depending on the needs of the user. The springs 224 preferably bias the base assembly 206 in a position perpendicular to the vertical rod 202. As the cane is carried forward by the user, the rear edge of the base assembly will first engage the ground and pivot with respect to the rod 202 until making full contact with the ground. The resulting tension on the springs provides a shock dampening affect and urges the rod 202 to a normal upright position.

In embodiments of the invention, an attachment, such as a forearm crutch attachment 232, can be coupled to the first angled section 228 of the cane as shown in FIG. 8. The forearm crutch attachment 232 in preferred embodiments has a straight bar 234 coupled to the first angled section 228 by bolts 234, screws or other fasteners which can be easily removed as needed. Alternatively, the bar 234 can be bent or curved to provide the desired angle of the bar and the cuff with respect to the first angled section. A semi-circular cuff 236 is attached to an upper end of the bar for receiving a user's forearm as in a conventional forearm crutch. In preferred embodiments the first angled section of the crutch is at an angle to mount the forearm crutch attachment in the desired angle. In a similar manner the second angled section is at an angle to be gripped by the user when the forearm crutch attachment is coupled to the crutch as shown in FIG. 8. In the event the forearm crutch attachment or other attachment places the center of gravity off center of the vertical rod, the tension of the springs can be selected to hold the cane in the upright position.

The base assembly similar to that shown in FIG. 8 may also be constructed to accept a standard cane. In this embodiment the base assembly includes a coupling means to attach the standard cane to the base. The coupling means may be a hollow tube pivotally coupled to the base. A set screw or clamping arrangement is provided on the upper end of the hollow tube so that the cane tip is inserted into the tube and secured by tightening the set screw or clamping arrangement. This arrangement allows the user to modify their standard cane by removably coupling the cane tip to the pivotable base, thereby increasing surface area and traction. The hollow tube on the base assembly preferably has a pair of springs extending from the tube to the base to bias the tube and cane in the upright position similar to the embodiment of FIG. 8. The base assembly being attachable to a standard cane enables the cane to have increased traction, to be able to stand erect and be safer to use than standard canes.

Figure 10:
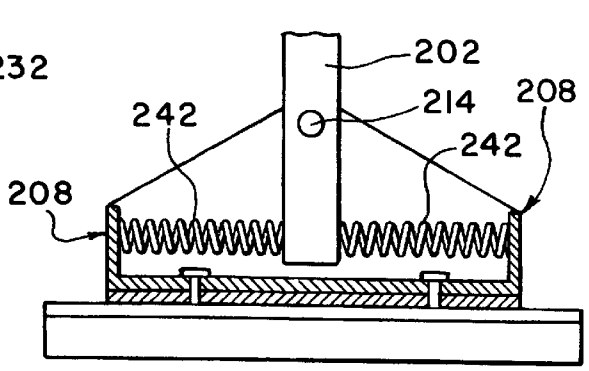
FIG. 10 is a side view in partial cross-section of the crutch in a further embodiment showing the pair of opposing springs below the pivot point of the vertical member.
Figure 9:
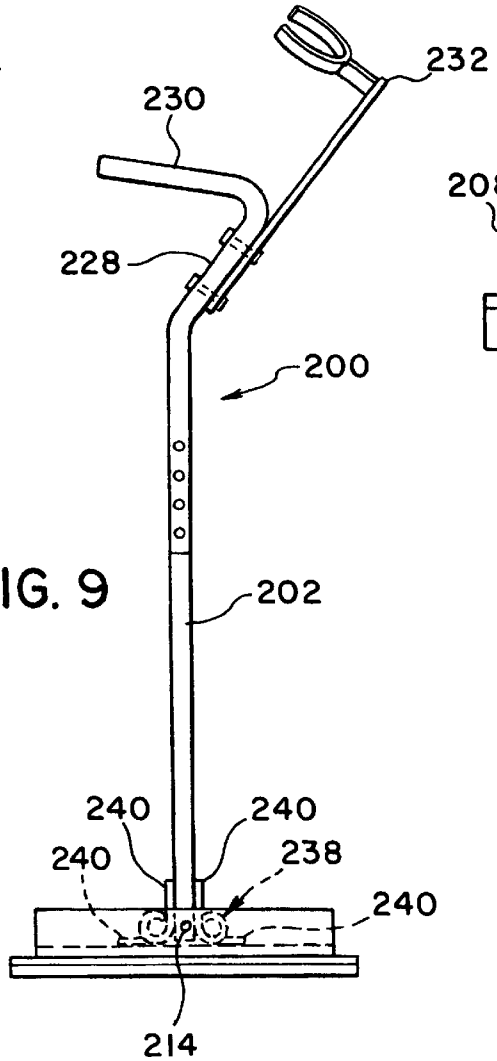
FIG. 9 is a side elevational view of a cane in a further embodiment of the crutch showing a pair of springs biasing the vertical member in an upright position.

Various other arrangements of spring assemblies can be used to bias the vertical support in the upright direction as shown FIGS. 9–15. In the embodiments of FIGS. 9–15 identical components are identified by the same reference numbers. As shown in FIG. 9, the vertical support member 202 is pivotally coupled to a bracket 208 by a pivot pin 214 extending through a hole in the vertical support and in the two side walls. Two coiled springs 238 having legs 240 engage the bracket and the vertical rod to bias the rod upright. In the embodiment of FIG. 10, the pivot pin 214 is mounted so that the vertical support pivots about a point spaced from the end of the rod and has a lower end extending a short length below the pivot point. A spring 242 is mounted on each side of the lower end of the vertical support 202 having a first end contacting a respective end of the bracket and a second end contacting the lower end of the vertical support member. As shown in FIG. 10 the two springs bias the lower end of the support away from the ends of the bracket to a substantially upright position. In preferred embodiments the springs are of substantially the same strength.

Figure 11:
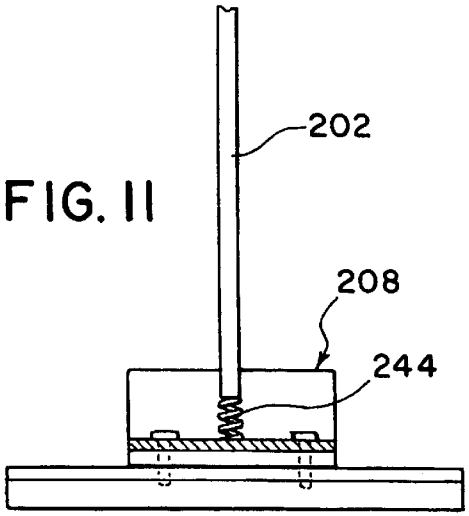
FIG. 11 is a side view in partial cross-section of a further embodiment of the invention showing a single spring biasing the vertical member in an upright position.

Referring to FIG. 11, a single spring 244 is coupled to the bottom of the bracket 208 and attached to the vertical support member 202. The side walls of the bracket have height sufficient to function as a guide to enable the vertical support member to pivot in a longitudinal direction with respect to the base. The spring has sufficient flexibility to bend during use and to bias the vertical support member in the upright position.

Figure 12:
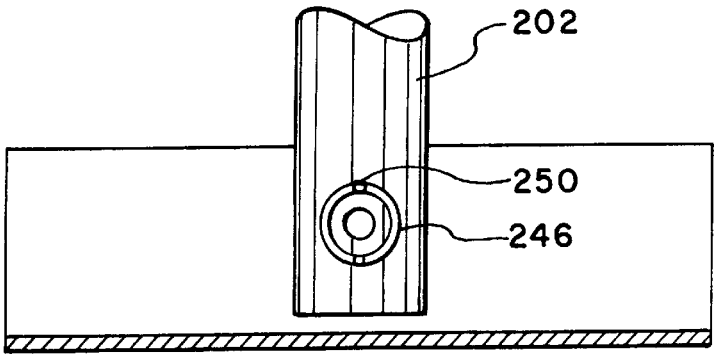
FIG. 12 is a side view in partial cross-section of a further embodiment showing a circular spring for biasing the vertical member in an upright position.
Figure 13:
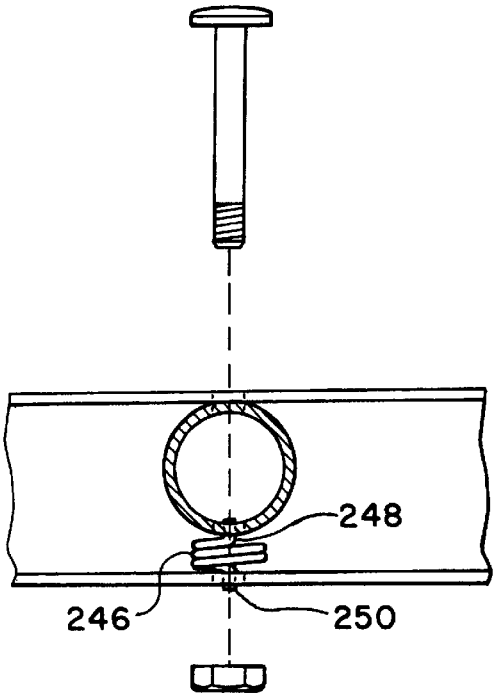
FIG. 13 is a top view of the base and spring assembly of FIG. 12.

FIGS. 12 and 13 show a further embodiment of the invention where a coil spring 246 is used to bias the vertical support 202 in the upright position. The spring 246 has a circular shape with a first leg 248 received in a hole in the side wall 124 of the base 114 and a second leg 250 received in a hole in the vertical support 202. In the embodiment shown the pivot pin or bolt extends through the center of the coil spring.

Figure 14:
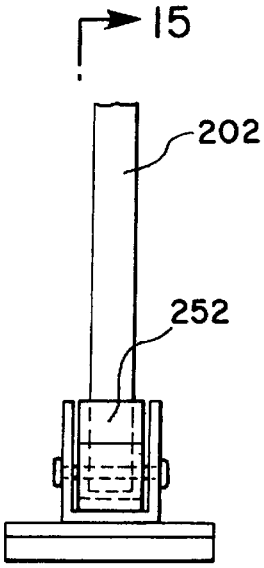
FIG. 14 is a partial end view of the base and biasing assembly of the cane in a further embodiment of the invention.
Figure 15:
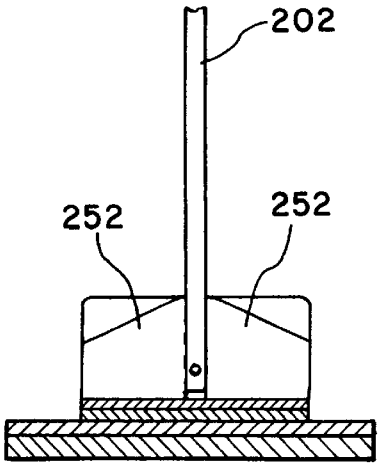
FIG. 15 is a partial cross-sectional view of the base and biasing assembly taken along line 15—15 of FIG. 14.

FIGS. 14 and 15 show a further embodiment of the invention where the vertical support member is biased by solid resilient members 252. Generally, the resilient members are made of a solid rubber-like material capable compressing to allow pivotal movement of the vertical support member 202 and having sufficient memory to bias the vertical support member 202 to an upright position.

Figure 16:
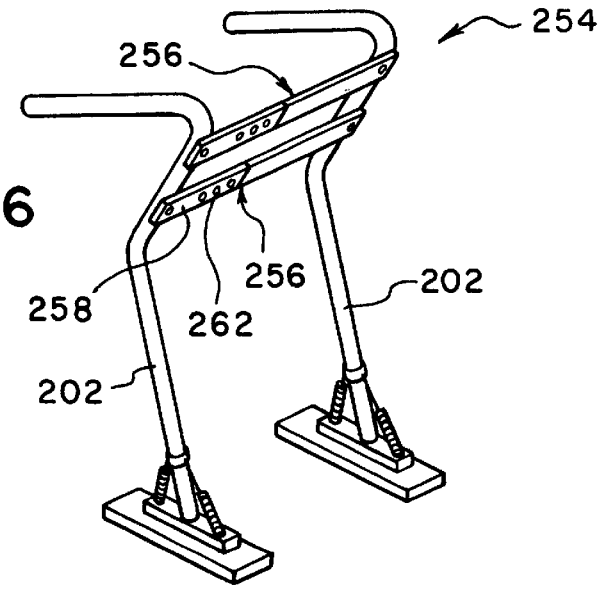
FIG. 16 is a perspective view of the walker assembly in a further embodiment of the invention.
Figure 17:
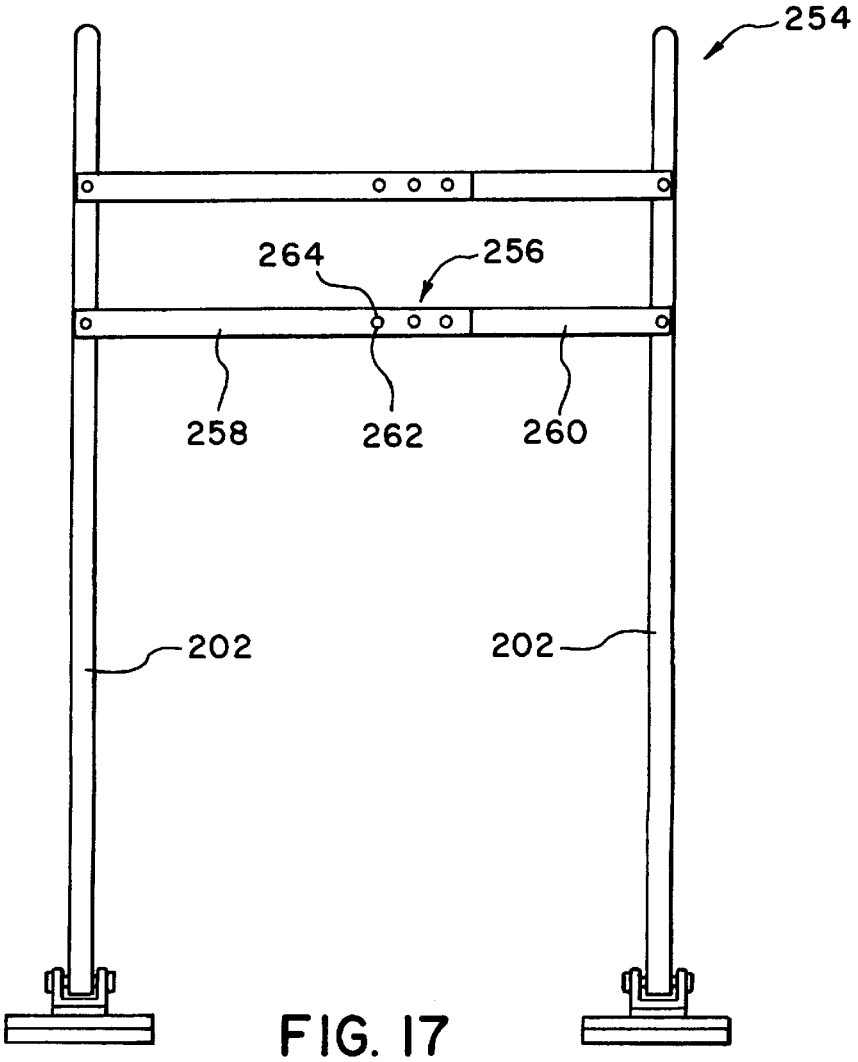
FIG. 17 is a front view of the walker assembly of FIG. 16.

The articulated vertical support can be used in a walker-type device 254 as shown in FIGS. 16 and 17 where each side of the walker is a mirror image of the other and where the sides of the walker are coupled together by at least one cross-bar 256. The walker 254 includes two of the canes of the embodiment of FIG. 8 without the forearm crutch attachment so that like elements are identified by the same reference numbers. In preferred embodiments, two cross-bars 256 are attached to each of the vertical support members 202 by screws or other suitable fasteners. The cross-bars 256 include two telescoping members 256, 260 which are attached together. As shown in FIG. 17 a plurality of holes 262 is provided in the telescoping member 258 for receiving a screw 264, bolt or other fastener for selectively adjusting the width of the walker-like device. The device of FIGS. 16 and 17 is used in similar fashion as the cane of FIG. 8. The user grips the handle portions of the walker and moves in a forward direction whereby the vertical support members pivot with respect to the bases. The walker is then lifted and placed forward of the user to take further steps.

While the invention has been described in connection with what is presently considered to be preferred embodiments, it is to be understood that the invention is not limited to the disclosed embodiments, but is intended to cover various modifications and equivalent arrangements included within the spirit and scope of the appended claims.

What is claimed is:

1. A mobility assisting device comprising:

a substantially planar ground engaging base with a resilient skid resistant sole and having a longitudinal dimension;

a bracket coupled to said base and having a longitudinal dimension substantially parallel to said longitudinal dimension of said base, said bracket being pivotable along a longitudinal axis of said base and being biased in a substantially upright direction with respect to said base;

a vertical support having a bottom end pivotally coupled to said bracket and being pivotable with respect to said bracket in said longitudinal dimension of said bracket and said longitudinal dimension of base, said vertical support having a top end with a handle portion coupled thereto; and a spring biasing assembly for biasing said vertical support in an upright direction wherein said spring biasing assembly comprises first and second springs having a first end contacting said bracket and a second end contacting said vertical support member.

2. The mobility assisting device of claim 1, comprising a resilient pad positioned between said base and said bracket to bias said bracket in said upright position.

3. A mobility assisting device comprising:

a substantially planar ground engaging base with a resilient skid resistant sole and having a longitudinal dimension;

a bracket coupled to said base and having a longitudinal dimension substantially parallel to said longitudinal dimension of said base, said bracket being pivotable along a longitudinal axis of said base and being biased in a substantially upright direction with respect to said base;

a vertical support having a bottom end pivotally coupled to said bracket and being pivotable with respect to said bracket in said longitudinal dimension of said bracket and said longitudinal dimension of base, said vertical support having a top end with a handle portion coupled thereto; and a spring biasing assembly for biasing said vertical support in an upright direction, wherein said spring biasing assembly is a coil spring having a first end coupled to said bracket and a second end coupled to said vertical support.

4. A mobility assisting device comprising:

a substantially planar ground engaging base with a resilient skid resistant sole and having a longitudinal dimension;

a bracket coupled to said base and having a longitudinal dimension substantially parallel to said longitudinal dimension of said base, said bracket being pivotable along a longitudinal axis of said base and being biased in a substantially upright direction with respect to said base;

a vertical support having a bottom end pivotally coupled to said bracket and being pivotable with respect to said bracket in said longitudinal dimension of said bracket and said longitudinal dimension of base, said vertical support having a top end with a handle portion coupled thereto; and a spring biasing assembly for biasing said vertical support in an upright direction, wherein said spring biasing member comprises a first solid resilient block having a face engaging a first face of said vertical support member and a second solid resilient block engaging a second face of said vertical support member.

5. A mobility assisting device comprising:

a substantially planar base having a longitudinal dimension;

a bracket coupled to said base and having a longitudinal dimension substantially parallel to said longitudinal dimension of said base, said bracket being pivotable along a longitudinal axis of said base and being biased in a substantially upright direction with respect to said base;

a vertical support having a bottom end pivotally coupled to said bracket and being pivotable with respect to said bracket in said longitudinal dimension of said bracket and said longitudinal dimension of base, said vertical support having a top end with a handle portion coupled thereto;

a first spring having a first end coupled to said vertical support at a location spaced from said bottom end and having a second end coupled to a first longitudinal end of said base; and a second spring having a first end coupled to said vertical support and a second end coupled to a second longitudinal end of said base, said first and second springs biasing said vertical support in an upright: direction with respect to said base.

6. The mobility assisting device of claim 5, further comprising a resilient pad positioned between said bracket and said base, and a coupling device extending from said bracket through said resilient pad to said base, wherein said resilient pad is under sufficient compression to bias said bracket and vertical support in an upright direction.

7. The mobility assisting device of claim 5, wherein said vertical support includes a first angled section extending in a substantially upward direction at an angle with respect to said vertical support, a second section angled section coupled to said first angled section and extending at an obtuse angle with respect to a longitudinal axis of said first section, said second angled section forming said handle portion.

8. The mobility assisting device of claim 7, wherein said first angled section extends at an angle of about 70 degrees with respect to said vertical support and said second angled section extends at an angle of about 92.5 degrees with respect to said vertical support.

9. The mobility assisting device of claim 8, further comprising a bar coupled to said first angled section, and a cuff coupled to said bar for receiving a user's forearm.

10. A mobility assisting device comprising:

a substantially planar base;

a bracket coupled to said base and having first and second longitudinal ends;

a vertical support pivotally coupled to said bracket and being pivotal in a first direction substantially parallel to a longitudinal dimension of said base;

a resilient and flexible pad disposed between said bracket and said base, said pad allowing limited pivotal movement of said bracket in a second direction perpendicular to said first direction and biasing said bracket and support in a substantially upright direction with respect to said base;

a spring assembly coupled to said vertical support for biasing said vertical support in an upright direction with respect to said base;

an underarm support pivotally coupled to said upper end of said vertical support;

a first tension member extending from a first longitudinal end of said base to a first end of said underarm support;

a second tension member extending from a second longitudinal end of said underarm support;

said tension members being coupled to said base and underarm support whereby said underarm support and base pivot relative to said vertical support to remain substantially parallel to each other.

11. The mobility assisting device of claim 10, wherein said spring assembly comprises first and second springs having a first end and a second end, wherein said second ends of said first and second springs are coupled to longitudinal ends of said bracket.

12. The mobility assisting device of claim 10, said tension member comprising rods or cables having an upper and lower end.

13. The mobility assisting device of claim 10, wherein said tension member is a cable extending from said base to said underarm support, and further comprising a spool coupled to said cable for adjusting the tension of said cable.

14. The mobility assisting device of claim 12, wherein each of said tension members includes a bar coupled to said bracket and to said lower end of said rods for adjusting the length of said rods.

15. The mobility assisting device of claim 10, wherein said spring assembly comprises a first spring extending from said vertical support to said first end of said bracket and a second spring coupled to said second end of said bracket and to said vertical support for biasing said vertical support in an upright direction with respect to said bracket.

16. A mobility assisting device comprising:

a pair of spaced apart support structures; and a connecting member for connecting said support structures together, each of said support structures comprising:

a substantially planar base;

a bracket coupled to said base;

a resilient shock dampening pad disposed between said bracket and base for absorbing shock and allowing limited pivotal movement of said base with respect to said bracket and biasing said bracket in a substantially upright direction with respect to said base;

a vertical support pivotally coupled to said base;

a spring assembly coupled to said vertical support for biasing said vertical support in a substantially upright direction with respect to said base; and a hand grip coupled to an upper end of said vertical support.

17. The mobility assisting device of claim 16, wherein said spring assembly comprises a first spring extending from each of said vertical supports to said first end of said brackets and a second spring coupled to said second end of said brackets and to said vertical supports for biasing said vertical supports in an upright direction with respect to said bases.

18. The mobility assisting device of claim 16, wherein said connecting member is removably coupled to said support structures.

19. The mobility assisting device of claim 16, wherein said connecting member is a telescoping assembly for adjusting a space between said support structures.

* * * * *